United States Patent [19]

Schneider

[11] Patent Number: 4,698,932

[45] Date of Patent: Oct. 13, 1987

[54] CLEANING APPARATUS

[76] Inventor: Michael P. Schneider, 1250 N. Tressy, Glendora, Calif. 91740

[21] Appl. No.: 947,190

[22] Filed: Dec. 29, 1986

[51] Int. Cl.[4] ..... A45D 24/44; F41C 31/00

[52] U.S. Cl. ..... 42/95; 15/104.18

[58] Field of Search ..... 42/95, 96; 15/104.18

[56] References Cited

U.S. PATENT DOCUMENTS

| | | | |
|---|---|---|---|
| 232,406 | 9/1880 | Lamb | 15/104.18 |
| 379,564 | 3/1888 | Davison | 15/104.18 |
| 453,316 | 6/1891 | Messina et al. | 15/104.18 |
| 481,858 | 8/1892 | Ferris | 15/104.18 |
| 705,396 | 7/1902 | Garrison | 15/104.18 |
| 876,276 | 1/1908 | Landes | 15/104.18 |
| 990,977 | 5/1911 | Griffith | 15/104.18 |
| 2,653,334 | 9/1953 | Bay | 15/104.18 |
| 2,779,042 | 1/1957 | Benny | 15/104.18 |

FOREIGN PATENT DOCUMENTS

| | | | |
|---|---|---|---|
| 12612 | 1/1903 | Fed. Rep. of Germany | 15/104.18 |
| 2476 | of 1874 | United Kingdom | 15/104.18 |
| 6651 | of 1889 | United Kingdom | 15/104.18 |

*Primary Examiner*—Charles T. Jordan
*Assistant Examiner*—Michael J. Carone
*Attorney, Agent, or Firm*—Sheldon & Mak

[57] ABSTRACT

An apparatus for cleaning an interior surface of a barrel of a gun which shoots soft projectiles. The device has a cleaning tip which expands when inside the barrel. Surrounding the cleaning tip is an elastic member which (i) biases the tip toward its contracted position and (ii) sealingly contacts the interior surface of the barrel when in the expanded position to thereby clean the surface.

15 Claims, 2 Drawing Figures

CLEANING APPARATUS

BACKGROUND

Figure 2:
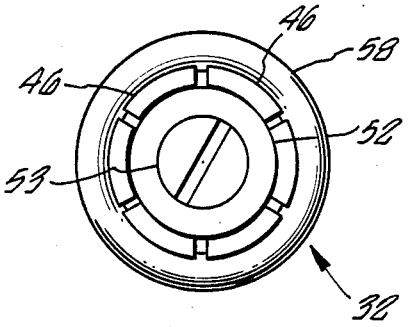

The present invention is related to firearms and the like, and more particularly to an apparatus for cleaning an interior surface of a barrel of a gun for shooting soft projectiles.

Mock war games are a growing sport throughout the world. During any given week, hundreds of thousands of individuals engage in this sport. A key part of the sport is a gun which is capable of shooting soft projectiles. These soft projectiles generally contain paint and burst upon impact. Often the casualties of these mock war games are the soft projectile shooting guns. Due to various causes, such as defective projectiles and the accumulation of dirt and other debris on the inside of the gun's barrel, the soft projectiles periodically burst prematurely within the barrel of the gun. When this happens, the paint and particulate debris that's spewed over the interior surface of the barrel prevents continued operation of the gun. At present there is no apparatus which can conveniently and effectively clean the paint and debris from the interior surface of the barrel for restoring the gun to satisfactory operation. Accordingly, there is a need for an apparatus that can effectively and conveniently clean the interior surface of the barrel of the soft projectile shooting gun.

SUMMARY

The cleaning apparatus of the present invention satisfies this need. This apparatus can be used to conveniently and effectively clean paint and other debris from the interior surface of a soft projectile shooting gun's barrel. The apparatus comprises (a) an elongate, hollow shaft having first and second ends; (b) a rod movably positioned in the shaft; (c) actuator means proximate the first end of the shaft for moving the rod relative to the shaft; (d) tip means proximate the second end of the shaft, the tip means being expandable from a contracted condition; (e) means for expanding the tip means from the contracted condition in response to movement of the rod relative to the shaft, the expanding means producing radially outward movement against the tip means; and (f) means proximate the tip means (i) for biasing the tip means toward the contracted condition and (ii) for sealingly contacting the interior surface of the barrel when the tip means is in an expanded condition.

In accordance with the present invention, the tip means can be inserted into the barrel of the gun and a force can be applied to the actuator means to move the rod relative to the shaft. The movement of the rod relative to the shaft causes the expanding means to produce radially outward movement against the tip means, thereby expanding the tip means from the contracted condition to the expanded condition so that the biasing means sealingly contacts the interior surface of the barrel. In the expanded condition, the tip means can be withdrawn from the barrel as the biasing means removes foreign material, e.g., paint and other debris, from the interior surface of the barrel. In addition, the biasing means can return the tip means to its contracted condition when the force is released from the actuator means.

In one apparatus embodying features of the present invention, the biasing means comprises an elastic member of the tip means. In another apparatus embodying features of the present invention, the biasing means comprises an elastic member, e.g., an O-ring, in contact with an exterior surface of the tip means. The exterior surface optionally has a groove therein. In order to prevent movement of the O-ring along the exterior surface of the tip means, the O-ring is preferably seated in the groove.

An exemplary actuator means is a pullpin which protrudes through at least one hole in a wall of the hollow shaft. The apparatus optionally further comprises a handle attached proximate the first end of the shaft.

In another apparatus embodying features of the present invention, the tip means comprises (a) a base adapted to be secured to the second end of the shaft; and (b) a plurality of fingers pivotly attached to the base. An exemplary number of fingers is six.

A portion of the exterior surface of an exemplary tip means has a conical shape which circumferentially increases distal from the handle. Similarly, at least a portion of the interior surface of an exemplary tip means has a conical shape which circumferentially increases distal from the handle. An exemplary expanding means is a member which has an exterior surface that matingly engages the interior surface of the tip means. For example, the member can be cone-shaped.

DRAWINGS

Figure 1:
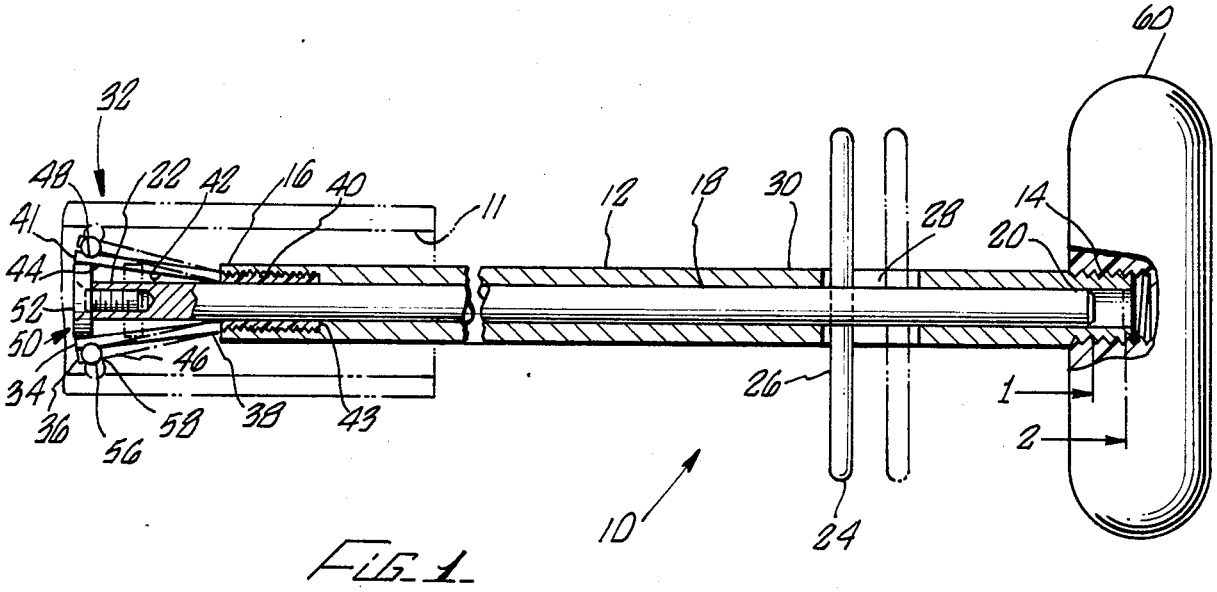

These and other features, aspects, and advantages of the present invention will become better understood from the following description, appended claims and accompanying drawing wherein:

FIG. 1 is a partial exposed view of an apparatus embodying features of the present invention; and FIG. 2 is an end view of the apparatus of FIG. 1.

DESCRIPTION

The present invention is directed to an apparatus that can easily and conveniently be employed to clean an interior surface of a barrel of a gun which shoots soft projectiles, e.g., paint balls. In addition, because the cleaning action is confined to a narrow contact band, enhanced cleaning action is obtainable with the apparatus of the present invention.

With reference to the figures, a cleaning apparatus 10 embodying features of the present invention is shown in relation to a gun barrel 11. The apparatus 10 comprises an elongate, hollow, shaft 12 having a first end 14 and a second end 16. A rod 18 is movably positioned in the shaft 12. The rod 18 has a first end 20 and a second end 22 proximate the first and second ends 14 and 16, respectively, of the shaft 12.

Actuator means 24 for moving the rod 18 relative to the shaft 12 are positioned proximate the first end 14 of the shaft 12. An exemplary actuator means 24 is a pullpin 26 which protrudes through at least one hole 28 in a wall 30 of the shaft 12. The pullpin 26 is connected to the rod 18 proximate the first end 20 of the rod 18.

Tip means 32 are proximate the second end 16 of the shaft 12 for selectively, slideably, and sealingly engaging the interior of the barrel 11. The tip means 32 are expandable from a contracted condition 34 to an expanded condition 36 in response to axial movement of the rod 18 from a first position 1 to a second position 2. An exemplary tip means 32 comprises a base 40 proximate a first end 43 of the tip means 32 and a plurality of pivotly attached fingers 42 proximate a second end 41 of the tip means 32. The base 40 is adapted to be secured to the second end 16 of the shaft 12. The fingers 42 have an interior surface 44 and an exterior surface 46. The exterior surface 46 preferably has a conical shape which circumferentially increases distal from the first end 14 of the shaft 12. Similarly, the interior surface 44 of the fingers preferably has a conical shape which also circumferentially increases distal from the first end 14 of the shaft 12. The number of fingers 42 can vary. The more fingers 42, the more closely the fingers 42 proximate the interior surface of the barrel 11 when expanded. This is advantageous because the closer the fingers 42 proximate a circular surface, the better will the cleaning action be. However, if there are too many fingers 42, the tip means 32 will be excessively fragile, lack structural integrity. An exemplary number of fingers 42 is from about four to about eight. Six fingers 42 have been found to be very satisfactory.

Means 50 expand tip means 32 from the contracted condition 34 in response to movement of the rod 18 relative to the shaft 12. The expanding means 50 are attached proximate the second end 22 of the rod 18 by fastening means, e.g. a screw 53. The expanding means 50 produce radially outward movement against the tip means 32. This is very important for the tip means 32 in order to get around accumulated paint in the barrel 11 of the gun and nevertheless be capable of sufficient expansion in order to firmly contact the inside surface of the barrel 11 when expanded. An exemplary expanding means 50 is a member 52 which has an exterior surface 54 that matingly engages the interior surface 44 of the tip 38. Exemplary members 52 are cylindrical as well as cone-shaped. The member 52 produces a radially outward movement against the tip 38 in response to axially movement of the rod 18.

The cleaning apparatus 10 also comprises a means 56 proximate the tip means 32 (i) for biasing the tip means 32 towards the contracted condition 34 and (ii) for sealingly contacting the interior surface of the barrel 11 when the tip means 32 is in an expanded condition 36. Exemplary biasing and sealing means 56 include an elastic member of the tip means, and an elastic member which is in contact with the exterior surface 46 of the tip means 32. The latter biasing and sealing means 56 include, but are not limited to, an O-ring 58 and a wedged shaped ring. In order to prevent movement of the O-ring 58 along the exterior surface 46 of the tip means 32, the exterior surface 46 preferably has a groove 48 therein proximate the second end 41 of the tip means 32. The O-ring 58 seats in the groove 48. In order to ensure that the O-ring 58 uniformly contacts the interior surface of the barrel 11 when the tip means 32 is in its expanded condition 36, the groove 48 is preferably coplanar.

The cleaning apparatus 10 optionally further comprises a handle 60 attached proximate the first end 14 of the shaft 12.

An exemplary configuration of the present invention is adapted for use with the barrel 11 having an inside diameter of 0.680 inch. In the contracted condition 34, the exterior diameter of the O-ring 58 is about 0.562 inch whereas in the expanded condition 36, the exterior diameter of the O-ring 58 is about 0.710 inch. Because the interior diameter of the gun's barrel 11 is about 0.680 inch, the cleaning apparatus 10 of the present invention provides sufficient radial expansion such that the O-ring 58 gets around large accumulations of paint on the interior surface of the barrel 11 but nevertheless makes firm contact with the interior surface of the barrel 11 when the tip means 32 is in the expanded condition 36.

The tip means 32 can be manufactured from material such as nylon and polypropylene. The tip means 32 can be manufacture from a dowel using standard manufacturing techniques. In order to obtain a satisfactory degree of flexibility while not sacrificing the structural integrity of the tip means 32, the fingers 42 of the tip means 32 are preferably from about 0.045 to about 0.050 inch thick.

In use, the tip means 32 is inserted into the gun barrel 11 and a force is applied to the actuator means 24 to move the rod 18 relative to the shaft 12. This movement of the rod 18 causes the expanding means 50 to produce radially outward movement against the tip means 32 thereby expanding the tip means 32 from the contracted condition 34 to the expanded condition 36. In the expanded condition, the biasing means 56, e.g., the O-ring 58, sealingly contacts the interior surface of the barrel 11. The tip means 32, while in the expanded condition 36, is withdrawn from the barrel 11 as the biasing means 56 wipes foreign material, e.g., paint and other debris, from the interior surface of the barrel 11. The biasing means 56 returns the tip means 32 to its contracted condition 34 when the force is released from the actuator means 24.

The cleaning apparatus 10 of the present invention is capable of achieving exceptional cleaning action. This is because a minimal amount of area is employed to clean the interior surface of the gun's barrel 11. For example, only a small portion of the the O-ring's surface contacts the interior surface of the barrel 11. Since pressure equals force per unit area, for a given force, the small area employed to clean the barrel's interior surface results in a lot of pressure being brought to bear on the surface to be cleaned. Another advantage of the cleaning apparatus 10 of the present invention is that the axial movement of the rod 18 produces generous a radial expansion of the tip means 32. Accordingly, when the tip means 32 is in the contracted condition 34, the tip means 32 can get around accumulated paint and other debris on the interior surface of the gun's barrel 11. However, the generous radial expansion enables the biasing and sealing means 56 to achieve excellent contact with the barrel's surface. Furthermore, the biasing and sealing means 56 serves two purposes. First, the biasing and sealing means 56 biases the tip means 32 towards the contracted condition 34. In addition the biasing and sealing means 56 sealingly contacts the interior surface of the barrel 11 when the tip means 32 is in the expanded condition 36 and is used to wipe the barrel's interior surface clean. Because of these advantageous features, the cleaning apparatus 10 of the present invention easily and efficiently cleans the interior surface of the gun's barrel 11.

Although the present invention has been described in considerable detail with reference to certain preferred versions thereof, other versions are possible. For example, the shaft 12 and rod 18 can be made of flexible material so that the cleaning apparatus 10 can be employed to clean the interior surface of conduits, e.g., pipes and air conditioning ducts, having a non-linear axis. Therefore, the spirit and scope of the appended claims should not necessarily be limited to the description of preferred versions contained herein.

What is claimed is:

1. An apparatus for cleaning an interior surface of a barrel of a gun for shooting soft projectiles, the apparatus comprising:

(a) an elongate, hollow, shaft having first and second ends;

(b) a rod movably positioned in the shaft;

(c) actuator means proximate the first end of the shaft for moving the rod relative to the shaft;

(d) tip means proximate the second end of the shaft, the tip means being expandable from a contracted condition;

(e) means for expanding the tip means from the contracted condition in response to movement of the rod relative to the shaft, the expanding means producing radially outward movement against the tip means; and (f) means proximate the tip means (i) for biasing the tip means toward the contracted condition and (ii) for sealingly contacting the interior surface of the barrel when the tip means is in an expanded condition, whereby (A) the tip means can be inserted into the barrel of the gun, (B) a force can be applied to the actuator means to move the rod relative to the shaft, (C) causing the expanding means to produce radially outward movement against the tip means thereby expanding the tip means from the contracted condition to the expanded condition so that (D) the biasing means sealingly contacts the interior surface of the barrel, (E) the tip means in the expanded condition can be withdrawn from the barrel as the biasing means removes foreign material from the interior surface of the barrel, and (F) the biasing means can return the tip means to its contracted condition when the force is released from the actuator means.

2. The apparatus of claim 1 wherein the biasing means comprises an elastic member of the tip means.

3. The apparatus of claim 1 wherein the actuator means is a pullpin which protrudes through at least one hole in a wall of the hollow shaft.

4. The apparatus of claim 1 further comprising a handle attached proximate the first end of the shaft.

5. The apparatus of claim 1 wherein the biasing means is an elastic member in contact with an exterior surface of the tip means.

6. The apparatus of claim 5 wherein the biasing means is an O-ring.

7. An apparatus for cleaning an interior surface of a barrel of a gun for shooting soft projectiles, the apparatus comprising:

(a) a handle;

(b) a hollow, elongate, shaft attached to the handle proximate a first end of the shaft;

(c) a rod movably positioned in the shaft;

(d) a pullpin connected to the rod proximate a first end of the rod, the pullpin radially protruding through at least one hole in a wall of the hollow shaft for moving the rod;

(e) an expandable tip means attached proximate a second end of the shaft;

(f) means attached proximate a second end of the rod for expanding the tip means from a contracted condition to an expanded condition in response to movement of the rod relative to the shaft, the expanding means producing radially outward movement against the tip means; and (g) an O-ring in physical contact with an exterior surface of the tip means (i) for sealingly contacting the interior surface of the barrel to remove foreign material from the interior surface when the O-ring is withdrawn from the barrel with the tip means in the expanded condition and (ii) for biasing the tip means to the contracted condition.

8. The apparatus of claim 7 wherein the tip means comprises:

(a) a base adapted to be secured to the second end of the shaft; and (b) a plurality of fingers pivotly attached to the base.

9. The apparatus of claim 7 wherein at least a portion of the exterior surface of the tip means has a conical shape, which circumferentially increases distal from the handle.

10. The apparatus of claim 7 wherein the exterior surface of the tip means has a groove therein and the O-ring is seated in the groove.

11. The apparatus of claim 10 wherein six fingers are attached to the base.

12. The apparatus of claim 7 wherein at least a portion of an interior surface of the tip means has a conical shape which circumferentially increases distal from the handle.

13. The apparatus of claim 12 wherein the expanding means is a member having an exterior surface that matingly engages the interior surface of the tip means.

14. The apparatus of claim 12 wherein the expanding means is a cone-shaped member, the cone shaped member producing the radially outward movement against the tip means in response to axial movement of the rod.

15. An apparatus for cleaning an interior surface of a barrel of a gun for shooting soft projectiles, the apparatus comprising:

(a) a handle;

(b) a hollow, elongate shaft attached to the handle proximate a first end of the shaft;

(c) a rod axially movable in the shaft;

(d) a pullpin connected to the rod proximate a first end of the rod for moving the rod, the pullpin radially protruding through at least one hole in a wall of the hollow shaft;

(e) an expandable tip means having (i) first and second ends, (ii) a base proximate the first end of the tip means and adapted to be secured to the second end of the shaft, (iii) a plurality of conically extending fingers pivotly attached to the base, (iv) a coplanar groove in an exterior surface of each finger, the groove being proximate the second end of the tip means, and (v) a conically shaped interior surface facing the second end of the tip means;

(f) an expansion member attached proximate a second end of the rod, the expansion member having a conically shaped exterior surface that matingly engages the interior surface of the tip for moving the tip from a contracted condition to an expanded condition when a force is applied to the pullpin to pull the rod towards the handle; and (g) an O-ring seated in the grooves, the O-ring being capable of (i) sealingly contacting the interior surface of the barrel to wipe foreign material from the interior surface when the O-ring is withdrawn from the barrel with the tip in the expanded condition and (ii) returning the tip to the contracted condition when the force is released from the pullpin.

* * * * *